US010767856B2

(12) United States Patent
Serenellini

(10) Patent No.: US 10,767,856 B2
(45) Date of Patent: Sep. 8, 2020

(54) DOUBLE FLAME CROWN GAS BURNER

(71) Applicant: SOMIPRESS—SOCIETA' METALLI INIETTATI S.R.L., Castelfidardo (AN) (IT)

(72) Inventor: Paolo Serenellini, Castelfidardo (IT)

(73) Assignee: SOMIPRESS—SOCIETA' METALLI INIETTATI S.R.L., Castelfidardo (AN) (IT)

( * ) Notice: Subject to any disclaimer, the term of this patent is extended or adjusted under 35 U.S.C. 154(b) by 168 days.

(21) Appl. No.: 15/573,752

(22) PCT Filed: May 18, 2016

(86) PCT No.: PCT/EP2016/061152
§ 371 (c)(1),
(2) Date: Nov. 13, 2017

(87) PCT Pub. No.: WO2016/184922
PCT Pub. Date: Nov. 24, 2016

(65) Prior Publication Data

US 2018/0119947 A1 May 3, 2018

(30) Foreign Application Priority Data

May 19, 2015 (IT) ..... 102015000015912

(51) Int. Cl.
*F23D 14/08* (2006.01)

(52) U.S. Cl.
CPC ..... *F23D 14/085* (2013.01); *F23D 14/08* (2013.01); *F23D 2900/14062* (2013.01); *F23D 2900/14063* (2013.01)

(58) Field of Classification Search
CPC ..... F23D 14/085; F23D 2900/14062; F23D 2900/14063
USPC ..... 126/39 E
See application file for complete search history.

(56) References Cited

U.S. PATENT DOCUMENTS 1,664,508 A * 4/1928 Harper ..... F23D 14/085 137/625
2013/0269676 A1* 10/2013 Quintaba' ..... F23D 14/065 126/39 E

FOREIGN PATENT DOCUMENTS

CN 103423745 A * 12/2013

* cited by examiner

*Primary Examiner* — Steven B McAllister
*Assistant Examiner* — Benjamin W Johnson
(74) *Attorney, Agent, or Firm* — Egbert, McDaniel & Swartz, PLLC

(57) ABSTRACT

A gas burner has a body, a supply unit and a lid having a central flame crown and a peripheral flame crown. The supply unit has at least one supply duct, three injectors connected to said at least one supply duct, three Venturi tubes respectively associated with said injectors, wherein the injectors and the Venturi tubes have parallel horizontal axes and fixing means used to fix the Venturi tubes in position. The body of the burner has a central chamber and two peripheral chambers in communication with the Venturi tubes and with an upper central chamber and an upper peripheral chamber respectively disposed under the central flame crown and the peripheral flame crown.

9 Claims, 8 Drawing Sheets

DOUBLE FLAME CROWN GAS BURNER

The present patent application for industrial invention relates to a double flame crown gas burner, and in particular to a burner having flame crowns that are substantially flush to the cooktop and the peripheral flame crown with inward-facing flames.

WO2006/077086 discloses a gas burner with two injectors and one toroidal flame divider, wherein a first crown of holes is obtained for an outward-facing flame and a second crown of holes is obtained for an inward-facing flame.

The first injector supplies a "C" chamber that communicates by means of three vertical ducts with an annular chamber obtained in the flame divider. The second injector supplies a first horizontal Venturi pipe in communication with a second vertical Venturi pipe that ends in a disc-like chamber in communication with annular slits of the flame divider for emitting a stabilization flame.

Such a gas burner is characterized by complex construction because it must provide for a system to take the secondary air to supply the flame under the cooking appliance.

Moreover, the route of the primary air and gas mixture coming from the first injector is rather winding and this generates flow load losses. For this reason, the gas burner needs a stabilization flame.

WO2008/116773 discloses a double flame crown burner having a central flame crown and a peripheral flame crown, both with outward-facing flames, that is to say towards the periphery of the burner. The peripheral flame crown is supplied by means of two horizontal Venturi pipes that communicate by means of winding passages with an annular chamber that supplies the peripheral flame crown. In view of the above, the supply of the peripheral flame crown is not uniform and the flames on the peripheral flame crown do not have an equally distributed intensity. A central chamber is obtained between the horizontal Venturi pipes, wherein an injector is disposed to supply a vertical Venturi pipe in order to supply the central flame crown.

WO2013/064657, in the name of the same applicant, discloses a single flame crown burner with inward-facing flames, wherein the flame crown is substantially flush with the cooktop.

CN103423745/116773 discloses a double flame crown burner having a central flame crown and a peripheral flame crown, both with outward-facing flames. The central flame crown is supplied by a Venturi pipe with horizontal axis. The peripheral flame crown is supplied by two Venturi pipes with horizontal axis. Between the central flame crown and the peripheral flame crown a toroidal chamber is obtained, with openings in peripheral communication with the outside in order to take secondary air from the outside with respect to the peripheral flame crown and supply the central flame with secondary air. Such a configuration provides a non-homogeneous central flame because of the interference caused by the peripheral flame.

CH177397 discloses a cooktop with two outward-facing peripheral flame crowns supplied by two horizontal Venturi pipes disposed at different levels.

US2010/163013, in the name of the same applicant, discloses a burner having a central flame crown and a peripheral flame crown, wherein the central flame crown is fed by a vertical Venturi pipe and the peripheral flame crown is supplied by oblique Venturi pipes. Between the central flame crown and the peripheral flame crown a toroidal chamber is obtained, with openings in peripheral communication with the outside in order to take secondary air from the outside with respect to the peripheral flame crown and supply the central flame with secondary air. Such a configuration provides a non-homogeneous central flame because of the interference caused by the peripheral flame.

The purpose of the present invention is to eliminate the drawbacks of the prior art by disclosing a double flame crown gas burner that is effective and guarantees an homogeneous supply and distribution of the air-gas mixture in the external flame crown.

Another purpose of the present invention is to provide such a gas burner that has a reduced volume and slightly projects from the cooktop.

Another purpose of the present invention is to provide such a gas burner that is simple to make and install.

These purposes are achieved according to the invention with the characteristics of the independent claim 1.

Advantageous embodiments appear from the dependent claims.

The gas burner of the invention comprises:

a body intended to be disposed under a cooktop, a supply unit intended to be fixed to the body, and a lid mounted on the body above the cooktop.

The lid comprises holes that define a central flame crown and holes that define a peripheral flame crown, wherein the flame crowns have a vertical axis that coincides with the axis of the burner.

The supply unit comprises:

at least one supply duct to supply gas, a first, a second and a third injector connected to said at least one supply duct, a first, a second and a third Venturi tube respectively associated with said injectors, wherein the injectors and the Venturi tubes have parallel horizontal axes, and fixing means used to fix said Venturi tubes in position, and to fix said supply unit to said body of the burner.

The body of the burner comprises:

a central chamber in communication with said first Venturi tube and with an upper peripheral chamber with toroidal shape, which extends peripherally with respect to said central chamber and is disposed under said central flame crown of the lid, and two peripheral chambers respectively in communication with said second and third Venturi tube and with an upper peripheral chamber with toroidal shape, which extends peripherally with respect to said peripheral chambers and is disposed under said peripheral flame crown of the lid.

The lid is made in one single piece and is mounted on the body above the cooktop. The lid comprises the holes that define the central flame crown, the holes that define the peripheral flame crown and an intermediate portion that prevents the flow of secondary air from the outside of the peripheral flame crown.

In this way, when both the central flame crown and the peripheral flame crown operate, the flames of the peripheral flame crown generate a barrier and stop the secondary air flow to the central flame crown and the central flame crown operates only with the primary air delivered by the first Venturi tube.

The particular arrangement of the Venturi tubes, the structure of the chambers of the burner and the structure of the flame crowns of the lid provide a uniform distribution of the flames in the flame crown and make the burner especially effective in terms of flame power.

Additional features of the invention will appear clearer from the detailed description below, which refers to a merely illustrative, not limiting embodiment, as illustrated in the attached drawings, wherein.

Figure 1:
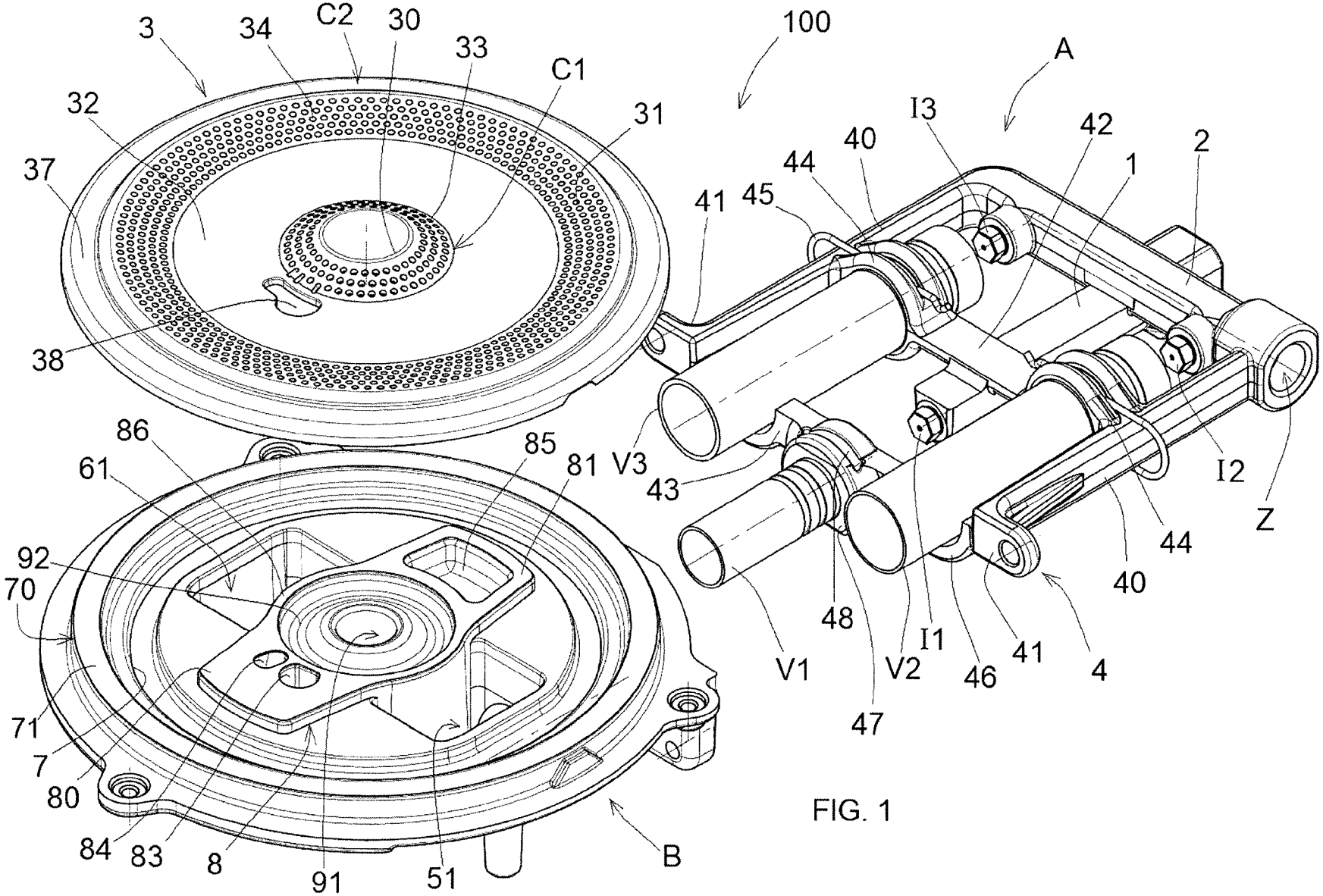
FIG. 1 is an exploded perspective view of the double flame crown gas burner of the invention.

With reference to the Figures, the gas burner according to the invention is disclosed, which is generally indicated with reference numeral (100). In the following description the terms "horizontal" and "vertical" refer to the situation in which the burner is mounted in a cooktop disposed along a horizontal plane.

With reference to FIG. 1, the burner (100) comprises:

- a body (B) intended to be disposed under a cooktop (not shown),
- a supply unit (A) intended to be fixed to the body (B) and disposed under the cooktop, and
- a lid (3) mounted on the body (B) above the cooktop.

The lid (3) has a disc-like shape and comprises a central flame crown (C1) and a peripheral flame crown (C2). The central flame crown (C1) has outward-facing flames (i.e. flames that get away with respect to the axis of the lid). The peripheral flame crown (C2) has inward-facing flames (i.e. flames that get closer with respect to the axis of the lid).

To that end the lid (3) comprises:

- a central truncated-conical portion (30)
- a peripheral tapered portion (31) with outward-increasing diameter, and
- a planar intermediate portion (32) with toroidal shape, disposed between the central truncated-conical portion (30) and the peripheral tapered portion (31).

A plurality of holes (33) on the lateral wall of the central truncated-conical portion form the central flame crown (C1). A plurality of holes (34) on the lateral wall of the peripheral tapered portion form the peripheral flame crown (C2).

With reference to Fig. the lateral wall of the central truncated-conical portion (30) is inclined by an angle ($\alpha$1) lower than 30°, preferably comprised between 23° and 27°, with respect to a horizontal plane, The holes (33) of the central flame crown have an axis (A1) orthogonal to the lateral wall of the central truncated-conical portion (30), In this way the flames of the central crown (C1) are directed upwards and outwards.

The peripheral tapered portion (31) is inclined by an angle ($\alpha$2) lower than 20°, preferably comprised between 8° and 12°, with respect to a horizontal plane. The holes (34) of the peripheral flame crown (C2) have an axis (A2) orthogonal to the peripheral tapered portion (31). In this way the flames of the peripheral crown (C2) are directed upwards and inwards.

Going back to FIG. 1, the geometrical structure of the lid (3) avoids excessively upward-projecting parts and therefore the lid (3) is maintained basically flush with the cooktop.

The lid (3) also comprises an external collar (37) disposed in peripheral position with respect to the peripheral flame crown (C2) and a slot (38) obtained in the planar intermediate portion (32) to receive a spark plug and a thermocouple (not shown in the drawings).

The supply unit (A) comprises a first duct (1) to supply gas to the central flame crown (C1) and a second duct (2) to supply gas to the peripheral flame crown (C2).

Figure 3:
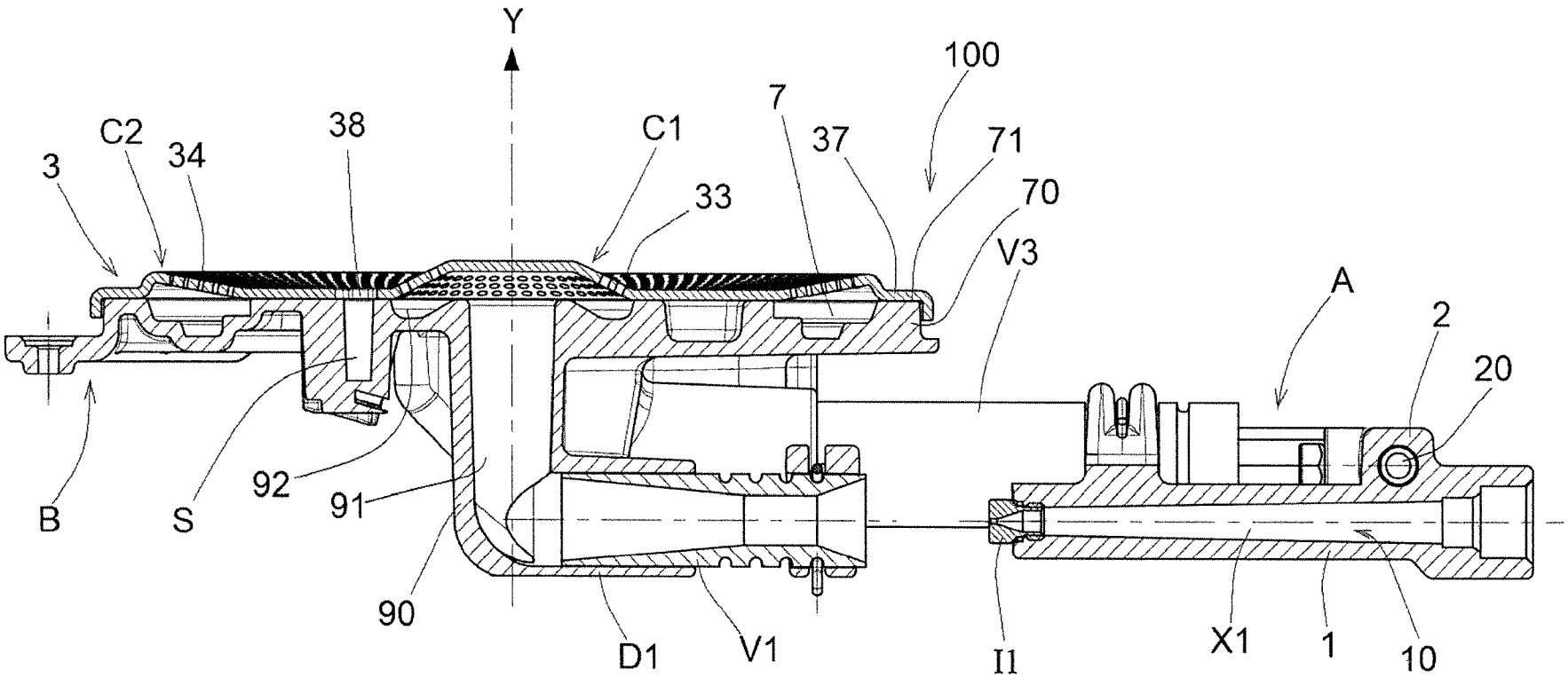
FIG. 3 is an axial view taken along the sectional plane III-III of FIG. 2.

With reference to FIG. 3, the first duct has a hole (10) with truncated-conical shape with a radial axis (X1) with respect to the axis (Y) of the burner coinciding with the axis of the flame crowns (C1. C2). The hole (10) of the first duct has a decreasing diameter going towards the body (B) of the burner.

The second duct (2) has a hole (20) with orthogonal axis (Z) (FIG. 1) with respect to the axis (X1) of the hole of the first duct. The second duct (2) is disposed above the first duct (1).

A first injector (I1) is disposed at one end of the first duct (1) to inject gas along the direction of the axis (X1) of the first duct.

Figure 6:
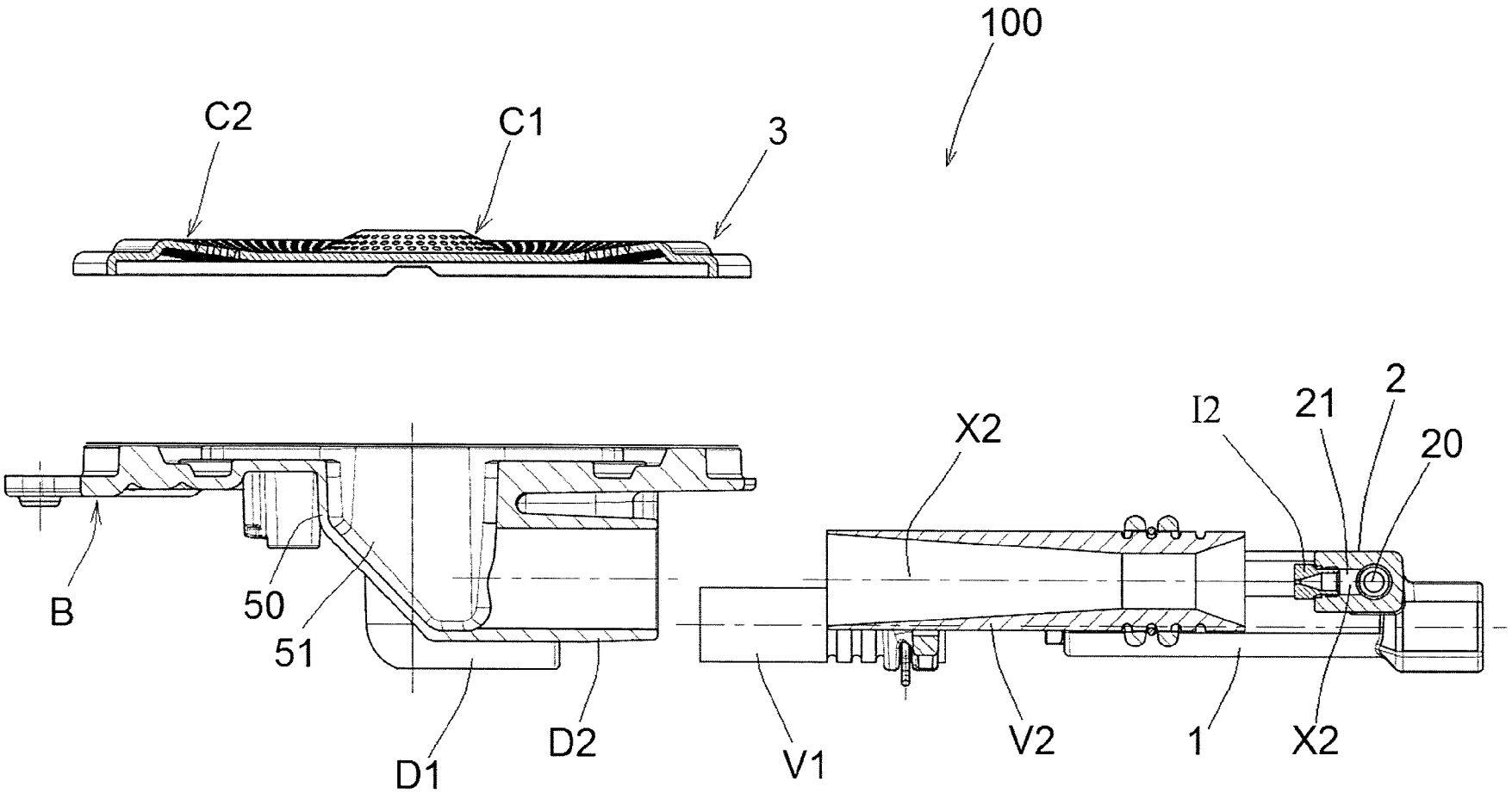
FIG. 6 is a sectional view taken along the sectional plane VI-VI of FIG. 2, which shows the parts of the burner in an exploded view.

With reference to FIG. 6, in the second duct (2) a first outlet hole (21) in communication with the hole (20) of the second duct is obtained. The first outlet hole (21) has an axis (X2) in orthogonal position to the axis (Z) of the second duct and in parallel position to the axis (X1) of the first duct (1). The first outlet hole (21) communicates with a second injector (I2) fixed to the second duct in such manner to inject gas along the direction of the axis (X2) of the first outlet hole of the second duct.

Figure 4:
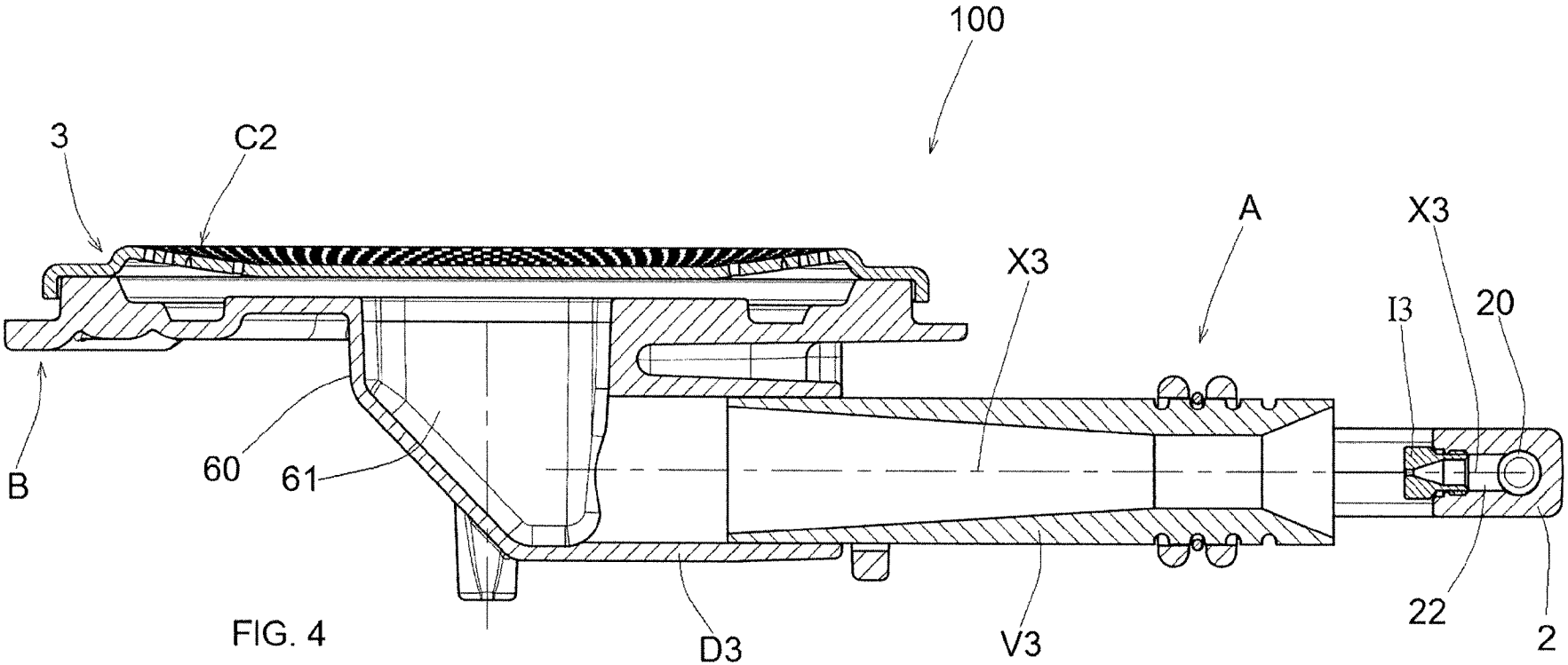
FIG. 4 is a sectional view taken along the sectional plane IV-IV of FIG. 2.

With reference to FIG. 4, in the second duct (2) a second outlet hole (22) in communication with the hole (20) of the second duct is obtained. The second outlet hole (22) has an axis (X3) in orthogonal position to the axis (Z) of the second duct and in parallel position to the axis (X1) of the first duct (1). The second outlet hole (22) communicates with a third injector (I3) fixed to the second duct in such manner to inject gas along the direction of the axis (X3) of the first outlet hole of the second duct. Therefore the three injectors (I1, I2, I3) have parallel horizontal axes (X1, X2, X3).

Although two independent supply ducts (1, 2) are shown in the Figures, a single supply duct can be provided and connected to the three injectors (I2, I2, I3) with parallel horizontal axes.

Figure 2:
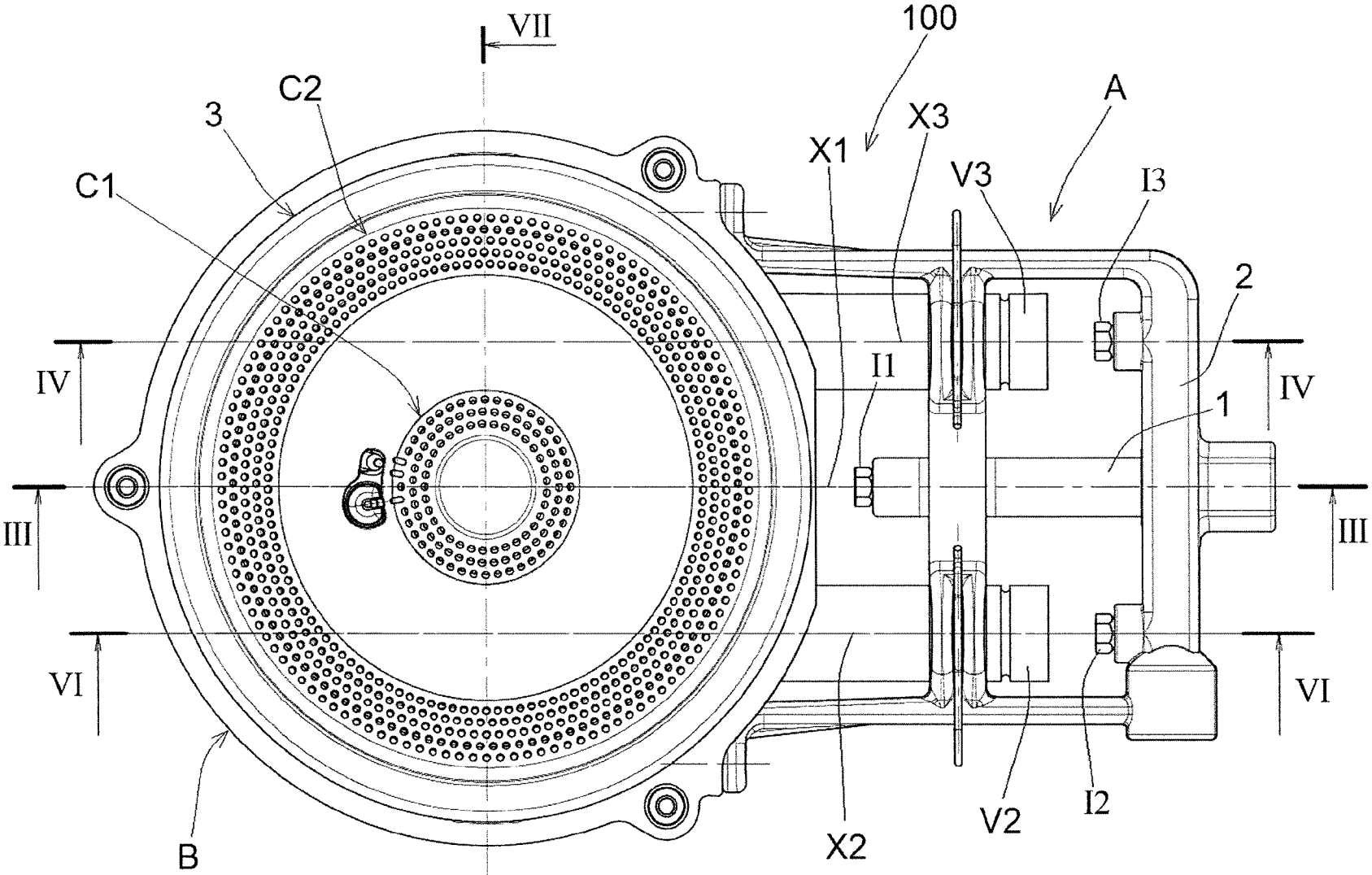
FIG. 2 is a top view of the burner of FIG. 1 in assembled condition.

With reference to FIGS. 1 and 2, the first injector (I1) is disposed between the second injector (I2) and the third injector (I3). The first injector (I1) is closer to the body (B) than the second injector (I2) and the third injector (I3). The distance between the second injector and the first injector is identical to the distance between the third injector and the first injector.

The supply unit (A) comprises a first Venturi tube (V1), a second Venturi tube (V2) and a third Venturi tube (V3) with axes coinciding with the axes (X1, X2, X3) of the injectors. The Venturi tubes (V1, V2, V3) are spaced out from the corresponding injectors (I1, I2, I3), in such manner that a mixture of gas and primary air taken under the cooktop flows in the Venturi tubes. Although it is not shown in the figures, the edge of the Venturi tubes may be flush with the injectors.

The second and the third Venturi tube (V2, V3) have the same diameter. The diameter of the first Venturi tube (V1) is lower than the diameter of the second and the third Venturi tube (V2, V3).

Fixing means (4) are used to fix the Venturi tubes (V1, V2, V3) in position, and to fix the supply unit (A) to the body (B) of the burner.

The fixing means (4) comprise two lateral brackets (40) connected to the second supply duct (2). The lateral brackets (40) extend in the same direction as the axes (X2, X3) of the second and the third injector (I2, I3). The lateral brackets (40) are provided with flanges (41) to fix the body (B) of the burner.

A first transverse bracket (42) and a second transverse bracket (43) are connected to the lateral brackets (40). The first transverse bracket (42) is disposed on the first supply duct (1). The first transverse bracket (42) comprises two collars (44) that receive the second and the third Venturi tube (V2, V3). Spring means (45) actuate on the collars (44) of the first transverse bracket to block the second and the third Venturi tube (V2, V3).

The second transverse bracket (43) is disposed at the end of the lateral brackets in proximity to the flanges (41). The second transverse bracket (43) comprises two arched housings (46) that receive and support the second and the third Venturi tube (V2, V3) and one central collar (47) that receives the first Venturi tube (V1). Spring means (48) actuate on the central collar (47) of the second transverse bracket to block the first Venturi tube (V1).

Figure 7:
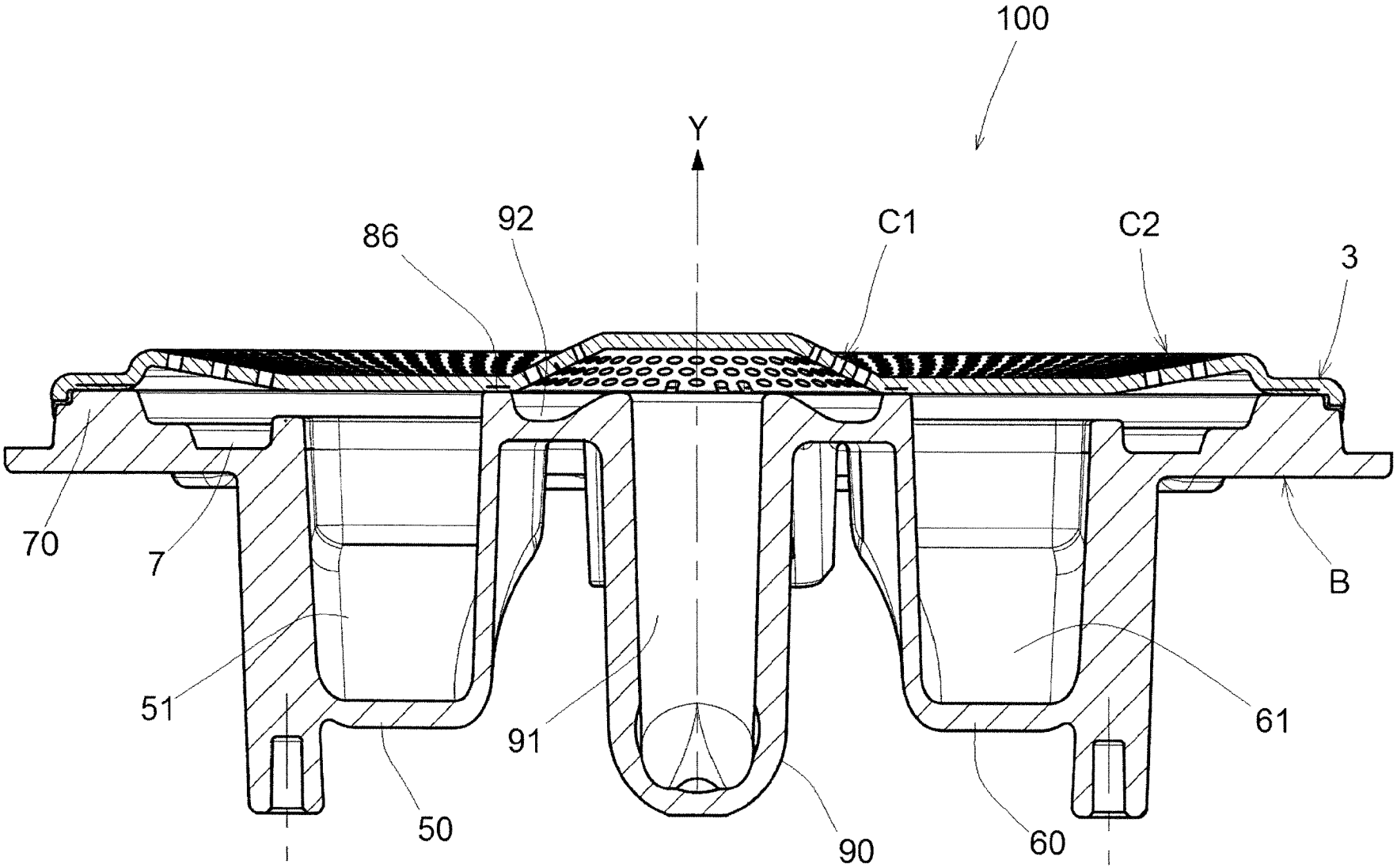
FIG. 7 is an axial view taken along the sectional plane VII-VII of FIG. 2.
Figure 8:
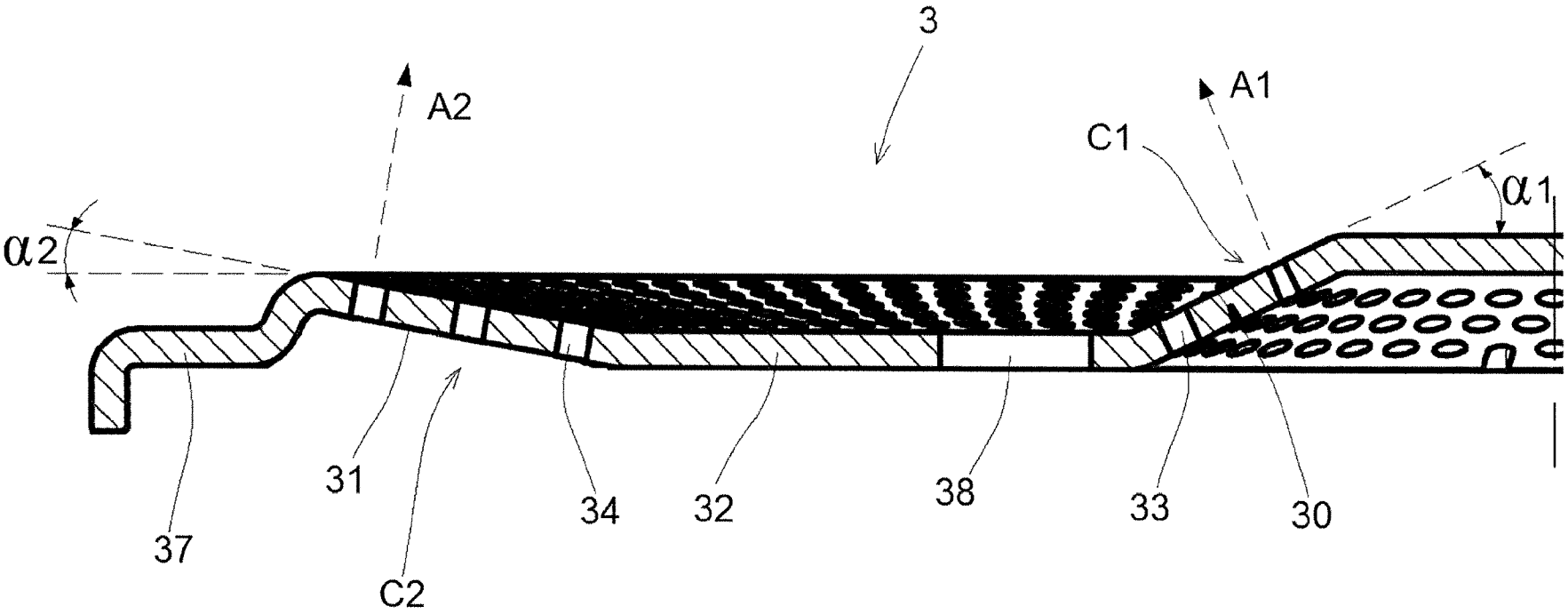
FIG. 8 is a partially interrupted axial view of the lid of the burner according to the present invention.

With reference to FIG. 7, the body of the burner comprises:

- a central portion (90) that defines a central chamber (91),
- a first peripheral portion (50) that defines a first peripheral chamber (51), and
- a second peripheral portion (60) that defines a second peripheral chamber (61), and The central chamber (91) has a basically cylindrical or truncated-conical shape with increasing diameter going upwards. The central chamber (91) has an axis (Y) that coincides with the vertical axis of the burner.

The peripheral chambers (51, 61) have a basically parallelepiped or tapered shape with increasing dimensions going upwards. The peripheral chambers (51, 61) are disposed in diametrally opposite positions with respect to the vertical axis (Y) of the burner.

With reference to FIG. 3, the body of the burner comprises a first inlet duct (D1) in communication with the central chamber (91). The axis of the first inlet duct (D1) coincides with the axis (X1) of the first Venturi tube (V1). In this way, the first Venturi tube (V1) is fitted into the first inlet duct (D1) of the body of the burner.

With reference to FIG. 6, the body of the burner comprises a second inlet duct (D2) in communication with the first peripheral chamber (51). The axis of the second inlet duct (D2) coincides with the axis (X2) of the second Venturi tube (V2). In this way, the second Venturi tube (V2) is fitted into the second inlet duct (D2) of the body of the burner.

Figure 5:
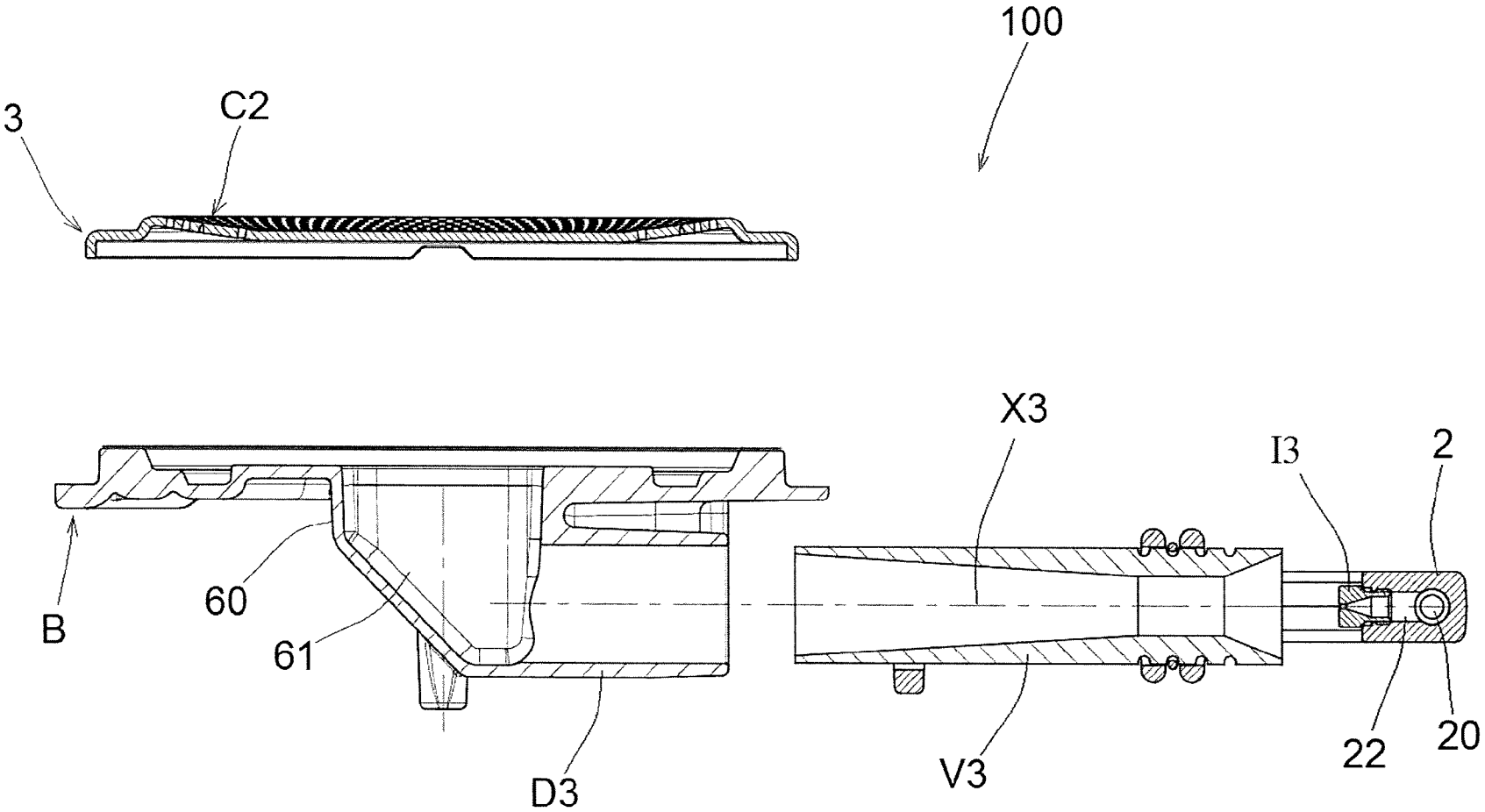
FIG. 5 is an exploded sectional view of the parts of the burner of FIG. 4.

With reference to FIGS. 4 and 5, the body of the burner comprises a third inlet duct (D3) in communication with the second peripheral chamber (61). The axis of the third inlet duct (D3) coincides with the axis (X3) of the third Venturi tube (V3). In this way, the third Venturi tube (V3) is fitted into the third inlet duct (D3) of the body of the burner.

The three inlet ducts (D1, D2, D3) of the body of the burner have parallel horizontal axes (X1, X2, X3). The first inlet duct (D1) is at a lower level than the second and the third inlet duct (D2, D3). In this way, the central chamber (91) is slightly longer than the peripheral chambers (51, 61).

With reference to FIGS. 1, 3 and 7, the central chamber (91) communicates with an upper central chamber (92) having a toroidal shape and extending peripherally with respect to the central chamber. The upper central chamber (92) is defined by an annular border (86) that extends upwards and is obtained with a flange (8) disposed above the body (B) of the burner.

With reference to FIGS. 1 and 7, the first peripheral chamber (51) and the second peripheral chamber (61) communicate with an upper peripheral chamber (7) having a toroidal shape and extending peripherally with respect to the peripheral chambers (51, 61). The upper peripheral chamber (7) is externally defined by a peripheral annular rib (70) that protrudes upwards and is provided with an upper planar surface (71).

The flange (8) comprises a first wing (80) and a second wing (81) extending in diametrally opposition directions with respect to the annular border (86) that defines the upper central chamber (92). The wings (80, 81) have a planar upper surface that is flush to the upper surface of the annular border (86). Two slots (83, 84) are obtained in the first wing (80) to house the spark plug and the thermocouple. A housing (85) intended to reduce the weight is obtained in the second wing (81).

When the lid (3) is disposed on the body (B), the external collar (37) of the lid is stopped against the planar upper surface (71) of the annular peripheral rib (70) of the upper peripheral chamber of the body and the planar intermediate portion (32) of the lid is stopped against the upper surface of the flange (8).

In view of the above, the central flame crown (C1) is disposed in register above the upper central chamber (92) and the peripheral flame crown (C2) is disposed in register above the upper peripheral chamber (7).

With reference to FIG. 3, the coupling between the external collar (37) of the lid and the upper planar surface (71) of the peripheral annular rib (70) of the body is continuous and does not generate any opening into which secondary air may flow, creating turbulence in the upper peripheral chamber (7).

Moreover, the spark plug and the thermocouple are disposed inside a housing (S) of the body (B) in register with the slot (38) obtained in the planer intermediate portion (32) of the lid. The housing (S) of the body does not communicate with the outside because no secondary air taken from outside needs to be ejected from the slot (38).

This description continues with reference to the operation of the gas burner (100) of the invention.

When gas is supplied in the first supply duct (1), the gas is ejected from the first injector (I1) along the direction of the horizontal axis (X1). Therefore, a gas and primary air mixture is sucked by the first Venturi tube (V1) with a horizontal axis (X1). The gas and air mixture sucked by the first Venturi tube (V1) is conveyed in the central chamber (91) of the body of the burner. The air and gas mixture flows upwards from the central chamber (91) towards the upper central chamber (92) and is ejected from the holes (33) of the central flame crown (C1) in order to be lit and generate upward and outward-facing flames.

When gas is supplied in the second supply duct (2), the gas is ejected from the second and the third injector (I2, I3) along the direction of the horizontal axes (X2, X3). Therefore, a gas and primary air mixture is sucked by the second and third Venturi tube (V2, V3) with horizontal axes (X2, X3). The air and gas mixture sucked by the second and third Venturi tube (V2, V3) is conveyed in the central chambers (51, 61) of the body of the burner. The air and gas mixture flows upwards from the peripheral chambers (51, 61) towards the upper peripheral chamber (7) and is ejected from the holes (34) of the peripheral flame crown (C2) in order to be lit and generate upward and inward-facing flames.

The central flame crown (C1) and the peripheral flame crown (C2) can work either simultaneously or separately.

The flames of the peripheral flame crown (C1) always take secondary air only from above the cooktop.

When only the central flame crown (C1) operates, the flames of the central flame crown (C1) take secondary air only from above the cooktop.

Instead, when both the central flame crown (C1) and the peripheral flame crown (C2) operate, the flames of the peripheral flame crown (C2) generate a barrier and stop the flow of secondary air to the central flame crown (C1). Therefore the central flame crown (C1) operates only with the primary air taken under the cooktop by the first Venturi tube (V1). Because of the special configuration of the burner (100), said operation of the central flame crown (C2), without secondary air, does not impair the correct operation of the burner. In particular, a more homogeneous flame is obtained on the central flame crown (C1) compared to the burners of the prior art wherein secondary air is supplied from the outside with respect to the peripheral flame crown towards the annular space between the central flame crown and the peripheral flame crown.

It must be noted that, because of the special arrangement of the Venturi tubes and of the special configuration of the body of the burner, the flow of the air and gas mixture from the peripheral chambers (51, 61) to the upper peripheral chamber (7) is rapid and uniform and does not follow a winding or curvilinear route. Consequently, a uniform gas distribution is obtained in the upper peripheral chamber (7), which permits to obtain uniform powerful flames in the peripheral flame crown (C2).

Numerous variations and modifications can be made to the present embodiment of the invention, which are within the reach of an expert of the field, falling in any case within the scope of the invention.

The invention claimed is:

1. A gas burner apparatus comprising:

a body adapted to be disposed under a cooktop;

a supply unit affixed to said body;

a central flame crown;

a peripheral flame crown, each of said central flame crown and said peripheral flame crown having a vertical axis aligned with an axis of the gas burner apparatus, the supply unit comprising:

at least one gas supply duct;

a first injector and a second injector and a third injector connected to said at least one gas supply duct;

a first Venturi tube and a second Venturi tube and a third Venturi tube respectively cooperative with said first injector, said second injector and said third injector, said first injector and said second injector and said third injector and said first Venturi tube and said second Venturi tube and said third Venturi tube having parallel horizontal axes; and a plurality of brackets fixing said first Venturi tube and said second Venturi tube and said third Venturi tube and said supply unit to said body, said body comprising:

a central chamber communicating with said first Venturi tube, said central chamber adapted to supply fuel to said central flame crown; and a pair of peripheral chambers respectively communicating with each of said second Venturi tube and said third Venturi tube and with an upper peripheral chamber of a toroidal shape, the upper peripheral chamber extending peripherally relative to said pair of peripheral chambers and disposed under said peripheral flame crown; and a single-piece lid mounted on said body and adapted to be mounted onto the cooktop, said single-piece lid having first holes that define said central flame crown and second holes that define said peripheral flame crown and an intermediate portion, the intermediate portion adapted to block a flow of secondary air from outside of said peripheral flame crown when said peripheral flame crown is in operation, wherein when both said central flame crown and said peripheral flame crown operate, a flame of said peripheral flame crown generates a barrier so as to block a flow of the secondary air to said central flame crown such that said central flame crown operates only with primary air delivered by said first Venturi tube, said lid comprising:

a central truncated-conical portion having a lateral wall on which the first holes are formed; and a peripheral tapered portion having an outer diameter on which the second holes are formed, the intermediate portion of said lid having a planar toroidal shape, the intermediate portion disposed between said central truncated-conical portion and said peripheral tapered portion.

2. The gas burner apparatus of claim 1, wherein said central chamber communicates with an upper central chamber, the upper central chamber having a toroidal shape, said upper central chamber extending peripherally with respect to said central chamber and disposed under said central flame crown.

3. The gas burner apparatus of claim 1, wherein the horizontal axis of said first Venturi tube is radial with respect to the axis of the gas burner apparatus, said second Venturi tube and said third Venturi tube being disposed on opposite sides of said first Venturi tube and equidistant from said first Venturi tube.

4. The gas burner apparatus of claim 3, wherein said central chamber has a vertical axis aligned with the axis of the gas burner apparatus, said pair of peripheral chambers being disposed in diametrically opposite directions.

5. The gas burner apparatus of claim 1, wherein the horizontal axes of said second Venturi tube and the third Venturi tube are at the same level, wherein the horizontal axis of said first Venturi tube is lower than the level of the horizontal axes of said second Venturi tube and said third Venturi tube.

6. The gas burner apparatus of claim 5, wherein said central chamber has a length that is greater than a length of the pair of peripheral chambers.

7. The gas burner apparatus of claim 1, said at least one supply duct comprises:

a first supply duct in communication with said first injector and adapted to supply gas towards said central flame crown; and a second supply duct disposed in an orthogonal position with respect to said first supply duct and in communication with said second injector and said third injector, said second supply duct adapted to supply gas towards the peripheral flame crown.

8. The gas burner apparatus of claim 7, said plurality of brackets comprising:

at least one lateral bracket connected to said second supply duct and fixed to said body; and at least one transverse bracket connected to said at least one lateral bracket, said at least one transverse bracket supporting said first Venturi tube and said second Venturi tube and said third Venturi tube.

9. The gas burner apparatus of claim 1, wherein the lateral wall of said central truncated-conical portion of said lid is inclined by less than 30° with respect to a horizontal plane, wherein the first holes of said central flame crown have an axis orthogonal to the lateral wall of the central truncated-conical portion, wherein the peripheral tapered portion of said lid is inclined by an angle less than 20° with respect to a horizontal plane, wherein the second holes of said peripheral flame crown have an axis orthogonal to said peripheral tapered portion.

* * * * *